US008164013B2

(12) United States Patent
Larcher et al.

(10) Patent No.: US 8,164,013 B2
(45) Date of Patent: Apr. 24, 2012

(54) CONTACT DEVICE FOR A HIGH RESISTIVE POWER CONTACTOR

(75) Inventors: Patrick Larcher, Echirolles (FR); Julien Guibert, Coise Saint Jean Pied Gauthier (FR); Joël Reboulet, Varces Allieres et Risset (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 442 days.

(21) Appl. No.: 12/453,300

(22) Filed: May 6, 2009

(65) Prior Publication Data

US 2009/0288935 A1 Nov. 26, 2009

(30) Foreign Application Priority Data

May 22, 2008 (FR) ..... 08 02780

(51) Int. Cl.
*H01H 1/06* (2006.01)

(52) U.S. Cl. ..... 200/275; 200/243; 200/284

(58) Field of Classification Search ..... 200/275, 200/243, 244, 280, 284
See application file for complete search history.

(56) References Cited

U.S. PATENT DOCUMENTS

| | | | | |
|---|---|---|---|---|
| 3,364,324 | A | 1/1968 | Pasi | 200/146 |
| 3,402,274 | A | 9/1968 | Bould | 200/146 |
| 4,470,028 | A * | 9/1984 | Vayre et al. | 335/16 |
| 4,926,019 | A | 5/1990 | Leone et al. | 200/147 R |
| 5,583,328 | A * | 12/1996 | Mitsuhashi et al. | 218/33 |
| 6,411,184 | B1 | 6/2002 | Comtois et al. | 335/106 |
| 6,636,401 | B1 | 10/2003 | Meiners et al. | 361/62 |
| 7,098,763 | B2 * | 8/2006 | Larcher | 335/132 |
| 7,217,895 | B1 * | 5/2007 | Shea et al. | 200/244 |

FOREIGN PATENT DOCUMENTS

DE 10028076 10/2001

* cited by examiner

*Primary Examiner* — Xuong Chung Trans
(74) *Attorney, Agent, or Firm* — Steptoe & Johnson LLP

(57) ABSTRACT

A contactor comprises, for each phase, a pair of contact devices which comprise a connection strip and at least two conductors provided with a stationary contact, and a movable contact bridge able to close the two stationary contacts or not. According to the invention, the contact device is formed from superposition of a number of pieces equal to the number of conductors, each piece comprising one of the conductors and a connection part corresponding to the connection strip but of smaller thickness. Each of the pieces can be made from folded metal. The connection parts are coupled to one another to form the connection strip by means of holes at the same time as the sets of bars are secured thereto.

20 Claims, 2 Drawing Sheets

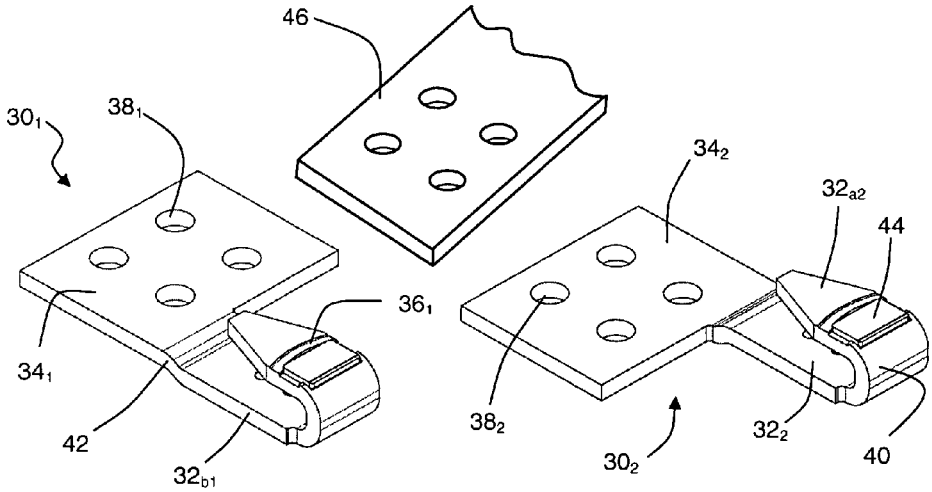
Fig. 3A
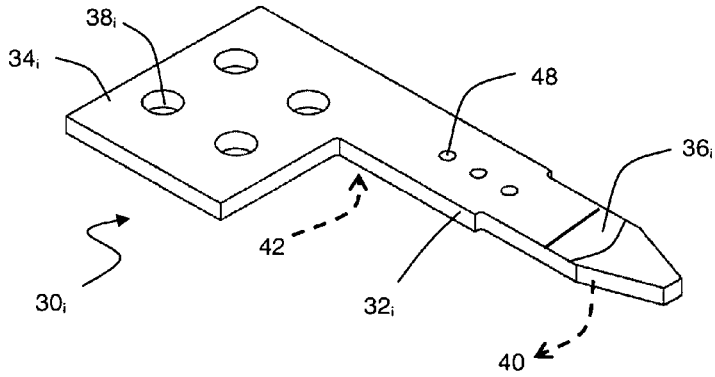
Fig. 3B
Fig. 3C
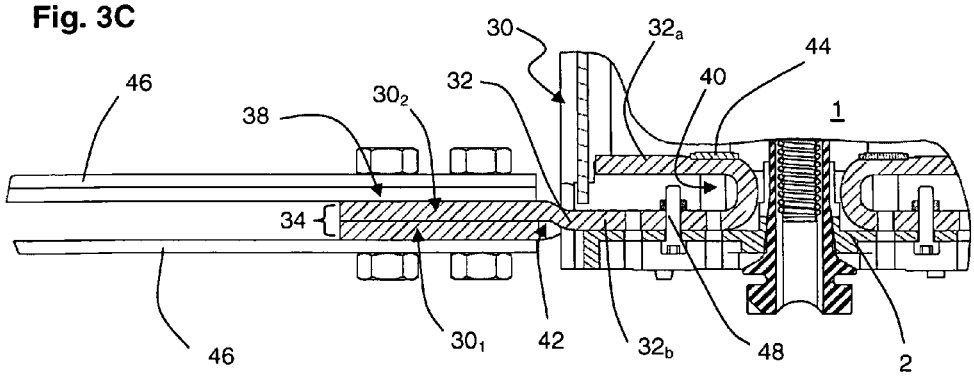

CONTACT DEVICE FOR A HIGH RESISTIVE POWER CONTACTOR

TECHNICAL FIELD

The invention relates to contact systems of electrical breaking and switching equipment, in particular contactors. The invention relates more particularly to the contact device extending between the connection terminal strip and the stationary contact area of such equipment, in particular in the case of use for high resistive power loads.

STATE OF THE ART

A contactor is a switching device with electric or pneumatic control the function of which is similar to that of an electromechanical relay, i.e. making or breaking the flow of current. This electrical engineering equipment with a high breaking capacity is in particular used to supply industrial motors with a power of more than 0.5 kW, and can withstand a higher current than the relay. Standardized categories of use, depending on the nature of the receiver and on the conditions in which closing and opening take place, fix the current values that the contactor has to withstand. For example, the AC3 category concerns high-power consumer loads, in particular squirrel-cage motors of elevator type, breaking of which takes place with the motor running. In particular, commercial contactors establish therein a start-up current that is five to seven times the rated current of the motor and on opening break the rated current absorbed by the motor. At this moment, the voltage at the terminals of the contactor poles is about 20% of the power system voltage and breaking remains easy.

Other switchgear units have a different regime that is less jerky, with for example larger opening/closing cycles, as for heating systems. In particular, AC switchgear units whose power factor (or cos $\phi$) is at least equal to 0.95 are assigned to the so-called AC1 category. The stresses on the contactors for these resistive uses are different: in particular for high powers, heat rise may become an important factor. AC1 contactors over 1500 A are thus conventionally based on the technology referred to as "contactor on bar", very bulky and made to measure, thereby being costly.

The document DE 100 28 076 describes one such contact device for an electric contactor.

Development of some fields, in particular wind power production or UPS inverter output, does however require AC1 contactors of increasingly high power, smaller dimensions and reduced cost, of the "molded case" type. Some factors can however not be ignored: the cross-section and therefore the weight of the contacts depend directly on the current that is to flow through the latter. Also, the connection terminals to the power supply system have to be of minimum size to comply with standards relating to the temperature they reach following resistive heating.

SUMMARY OF THE INVENTION

Among other advantages, an object of the invention is to palliate shortcomings of existing stationary contact devices, in particular for high-power applications with resistive loads. In particular, contacts having a geometry optimized to reduce heat rises and costs have been developed in order to offer a range of contactors with an increased operating scope while at the same time preserving acceptable overall dimensions. The invention finds a particularly advantageous application for contactors with a current of more than 1000 A or 1500 A in AC1 category, concerning in particular resistive heaters, lighting systems, wind power generators, etc.

According to one aspect, the invention thus relates to a contact device comprising a substantially flat and preferably rectangular connection terminal strip, wherein holes are drilled for connecting electric power supply bars, said terminal strip being extended by several conductors, preferably folded into a U, which comprise stationary contact areas. The final architecture of the contactor thereby makes the phase connections easier to see, each of these connections being associated with a single incoming, respectively outgoing, device and therefore only comprising a single connection strip on input, respectively on output. Connection errors are thereby prevented.

The contact device according to the invention preferably is made of copper, which can be devoid of protection, tin-plated or silver-plated, and the contact areas comprise supports onto which silver alloy pads are brazed. The thickness of the conductors is in particular given by the current intensity to which the contact device will be subjected, in particular more than 1000 A or 1300 A, in particular more than 1700 A, 2100 A, or even 2300 A. The orientation with respect to the contact areas and the size of the connection strip are optimized to minimize heat rise and also to facilitate connection of the bars. Advantageously, the connection surface of the bars is therefore identical to that of the connection strips so as to maximize the assembled copper masses thereby making for better heat dissipation. For example, for powers such as 2100 A, standards impose four power supply bars of given cross-section, and the connection strips are adapted to the latter, four holes in particular being drilled therein for coupling.

According to the invention, the contact device comprises a superposition of a number of pieces equal to the number of conductors. Each piece of the contact device is made from a metal sheet that is then folded into its final shape, and comprises one of the conductors secured to a connection part the shape of which is substantially the same as the connection terminal strip of the device. The connection parts of each piece of the contact device are thus superposed along their main plane, directly or with a conducting interface product taking up possible surface imperfections to form the connection terminal strip, which has in particular a thickness of 8 mm.

According to a preferred embodiment of the invention, the connection device comprises two symmetrical pieces, advantageously taken from the same metal cut and/or having had the same folds made. In particular, each piece of the device is made from copper of substantially constant thickness and comprises a rectangular connection part one side of which is extended by a flat branch of a conductor, offset orthogonally with respect to the rectangular part by half its thickness, then by a portion folded towards a parallel second conductor branch comprising a contact support arrangement on its surface opposite the first branch.

The first branch of each conductor can comprise holes for securing the pieces of the contact device in a case, the conductors then advantageously being parallel to one another. The connection parts of each piece also comprise holes that are superposed when the devices according to the invention are assembled so that connection of the power supply bars achieves securing of the connection parts on one another and optimizes electrical conduction. For the contact to be homogeneous, it is advantageous to fit four bolts on the connection surface.

According to another aspect, the invention relates to a switching equipment unit comprising a pair of similar contact devices the contact areas of which are arranged facing one another in a case, the connection strips being located outside said case. A movable contact bridge associated with an actuator can take a closed position in which it performs electrical conduction between the two connection strips and an open position in which it is separated from the contact devices. In a preferred embodiment, the switching unit is a three-phase contactor comprising three pairs of contact devices juxtaposed in the plane of the connection strips, associated with a movable contact bridge device simultaneously performing opening and closing between the three phases.

BRIEF DESCRIPTION OF THE DRAWINGS

Other advantages and features will become more clearly apparent from the following description of particular embodiments of the invention, given for illustrative purpose and non-restrictive and represented in the accompanying drawings.

FIGS. 3A, 3B, 3C show a piece and a contact device according to a preferred embodiment of the invention, and connection thereof.

DETAILED DESCRIPTION OF A PREFERRED EMBODIMENT

Figure 1:
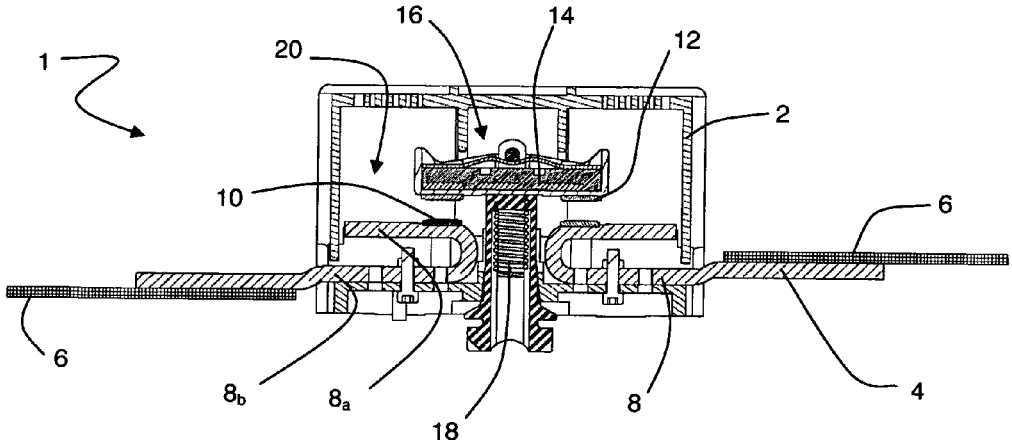
FIG. 1 illustrates a cross-section of a contactor on which the contact device according to the invention can be fitted.

The invention finds a particular and preferred application in a contactor 1 with a molded case 2 used in three-phase power supply. For each of the phases, contactor 1 comprises a conduction circuit as illustrated schematically in FIG. 1, the circuits being juxtaposed normally in the drawn plane (of the sheet), for example inside the same case 2.

In particular, according to a conventional construction, for each supply phase, two connection terminal strips 4 are protruding from case 2 of contactor 1 and are designed to be connected to a set of supply bars 6. Connection terminal strips 4 are extended inside case 2 by conductors 8 comprising two stationary contact areas 10 separated from one another. Contact areas 10 can, depending on the uses, either be manufactured unitarily with conductor 8 itself or be added on, with for example brazing of pads on a support arranged in conductor 8. Two contacts 12 coupled by a conductor 14 are located facing stationary contacts 10 and form a movable contact bridge 16. Movable contact bridge 16 is moved by an actuating device 18 between a closed position in which it performs electrical connection between stationary contacts 10 and an open position in which the current does not flow between connection terminal strips 4.

For electrodynamic reasons, it is more usual for conductor 8 to form a U shape at the level of stationary contact 10, as illustrated. A first branch $\mathbf{8}_a$ of conductor 8 supporting contact 10 is substantially parallel to a second branch $\mathbf{8}_b$ located at the bottom of case 2. The second branch $\mathbf{8}_b$ extends towards strip 4 which is here parallel to first branch $\mathbf{8}_a$, but other orientations of connection strip 4 can also be provided. Stationary contact device 20 comprising connection strip 4 and conductor 8 is usually made of copper, which conducts about 4.5 to 5 A/mm$^2$. The copper can be uncoated, tin-plated or silver-plated.

In addition to juxtaposition of contact devices 20 in case 2 for contactors 1 operating in multiphase power supply, for high-power applications it is conventional for conduction to be performed simultaneously on a plurality of stationary contacts 10 for optimization purposes. The contact resistance is in fact all the more reduced, and heat rises are therefore reduced. It is then possible to multiply the number of connection strips 4 which would thus extend each of conductors 8, to the detriment of ease of fitting by the operator, bars 6 of each phase then having to be connected on several strips 4. According to the invention, each phase is only associated with two connection strips 4 to which the different conductors 8 of the conduction circuit are coupled.

Figure 2A:
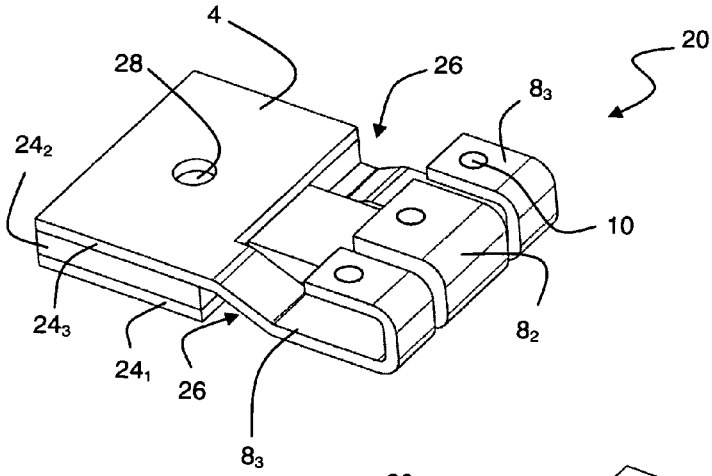
FIGS. 2A and 2B represent an embodiment of a contact device according to the invention.

Thus in particular for contactors 1 with high ratings, e.g. more than 1000 A, and as illustrated in FIG. 2A, stationary contact device 20 comprises a plurality of conductors $\mathbf{8}_i$, in this case three, that are provided with as many contact zones 10. Unlike the illustration, conductors 8 are advantageously of identical cross-section and of similar shape to optimize industrialization costs. Each of conductors 8, the cross-section of which is determined by the current flowing therein, is connected to connection strip 4, the size of the latter also meeting certain criteria. In particular the orientation, dimensions, and in particular the volume of connection strip 4 are limited by the ease of connection of a set of bars 6, but above all by thermal constraints. Indeed, for contactors 1 for a resistive load, the heat rise of contact devices 20 can become large with the power. As the temperature of connection strips 4, directly accessible to the public as they are external to case 2, is limited by standards, connection strip 4 is of consequent size.

Contact device 20 thus comprises a voluminous connection strip 4, usually made of copper, extended by a plurality of conductors 8 spaced apart from one another, also made of copper, each of conductors 8 forming a U with a branch $\mathbf{8}_b$ extending connection strip 4 and a parallel branch $\mathbf{8}_a$ comprising a contact support area 10. Contact support is conventionally an arrangement within branch $\mathbf{8}_a$ for a pad, for example made of silvered alloy, the size of which pad is optimized for the lifetime of contactor 1. To manufacture a device of this type, any forging, machining or molding of a unitary monoblock is discarded, for reasons of industrialization cost among others. One of the conventional manufacturing options is securing conductors 8 onto connection strip 4 by screwing/bolting as described in the document U.S. Pat. No. 3,402,274. This solution, apart from multiplication of the assembly steps, presents the drawback of overheating at the level of each bolting by creating a contact resistance, thereby resulting in loss of electrical conduction.

According to the invention, the folded technology is preferred. It is not onerous, is industrially optimized and is commonly applied for manufacturing contact conductors of breaking and/or switching equipment. It is however apparent that the industrial limit of this manufacturing fabrication is a thickness of 7 mm of copper. Above this, the reliability and realization of conductors 8 cannot be guaranteed. Thus, direct application of this folded technology to high power ranges cannot be envisaged. Inacceptable dimensions would then be generated for pour connection strips 4, the thickness of which would be limited by that of conductors 8 whereas its volume is determined by normative constraints.

Figure 2B:
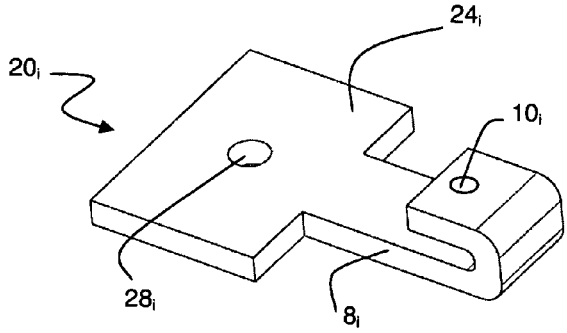

According to the invention and as represented schematically in FIGS. 2A and 2B, connection strip 4 is made in several parts $\mathbf{24}_i$, each of parts $\mathbf{24}_i$ having a smaller thickness than the folding limit (for example 7 mm for Cu) and being extended by one of contact conductors $\mathbf{8}_i$. The contact surface between the different parts $\mathbf{24}_i$ of connection strip 4 is preferably maximal, with superposition of the latter, so that the electrical resistance generated by their joining is minimized as is heating of connection strip 4, the dissipated heat being maximal. In particular, in the embodiment of FIG. 2, three unitary pieces $\mathbf{20}_i$ made from folded copper constitute contact device 20, each of the pieces comprising a conductor $\mathbf{8}_i$ supporting a contact $\mathbf{10}_i$ and a connection part $\mathbf{24}_i$ corresponding to a section of connection strip 4. Each of connection parts $\mathbf{24}_i$ is preferably of the same thickness, identical to that of conductors 8, even if other options are possible, as illustrated in FIG. 2A.

Contact device 20 is obtained by superposition of the different pieces $\mathbf{20}_i$. Contacts 10 are advantageously located on the same plane and folds 26 on conductors $\mathbf{8}_i$ enable the offset generated by superposition of connection parts $\mathbf{24}_1$, $\mathbf{24}_2$, $\mathbf{24}_3$ to be "taken up". Securing of pieces $\mathbf{20}_i$ of contact device 20 for a maximal contact surface can be achieved by any suitable securing means. To eliminate the negative effects of possible deformations of connection parts $\mathbf{24}_i$ by securing the latter, a conducting product can be arranged at the interface. When coupling is performed, the viscous product, for example a paste, fills the gaps that may form on the surfaces in contact to fill the cavities and thereby reduce the contact resistance between two connection parts $\mathbf{24}_i$, $\mathbf{24}_{i+1}$ and improve the thermal conductibility. This option can also prevent any internal oxidation of connection strip 4.

Preferably, to couple connection parts $\mathbf{24}_i$, screwing is provided at their level, with formation of at least one hole $\mathbf{28}_i$. Power supply bars 6 on connection strip 4 will advantageously be coupled by the same means 28. The size of hole 28 is determined by the necessary application force, which directly depends on the size of the bolt used. The number of holes 28 can moreover be increased.

According to a particularly advantageous embodiment, contact device 30 according to the invention comprises two symmetrical pieces $\mathbf{30}_1$, $\mathbf{30}_2$ produced by the same means to optimize the industrial investment. Illustrated in FIG. 3, it is particularly suitable for three-phase AC1 contactors 1 of 1700 or 2100 A, a range for which the dimensions will be given for indication purposes—the person skilled in the art will adapt the criteria according to the envisaged use, for example 1000 or 1300 or 2500 A, depending on the operating constraints, the available housing volume, etc.

Contact device 30 in particular comprises two conductors $\mathbf{32}_1$, $\mathbf{32}_2$, e.g. made of copper with a cross-section from 25 to 35 mm (for example 30 mm) on 5 to 7 mm. Conductors $\mathbf{32}_i$ extend connection strip 34 on one side, said strip 34 being of parallelepipedic shape, in particular rectangular, with sides of 70 to 85 or 100 mm and a thickness that is twice that of conductors 32. Connection strip 34 is divided in the direction of its thickness into two equal parts $\mathbf{34}_1$, $\mathbf{34}_2$. The two base pieces $\mathbf{30}_1$, $\mathbf{30}_2$ originating from cutting are superposable on one another: see FIGS. 3A and 3B. The two conductors $\mathbf{32}_i$ are preferably in the extension of two opposite sides of said strip 34, so that the lateral cut of the copper is straight over the whole length and is optimized.

Machining $\mathbf{36}_i$ can be performed at the level of the end of conductor $\mathbf{32}_i$ opposite connection strip $\mathbf{34}_i$, to prepare the surface for contact. Holes $\mathbf{38}_i$ are made in connection strips $\mathbf{34}_i$ to be able to clamp the latter against one another. Four holes 38 with a diameter of 10 to 20 mm, in particular 14 mm, are preferred, this choice optimizing the application force to ensure a good contact that reduces heating.

Each piece $\mathbf{30}_i$ is then folded to obtain its final shape. According to the preferred embodiment, two folds are made. One of the folds 40 concerns the U shape of conductor $\mathbf{32}_i$: the first end branch $\mathbf{32}_a$ of conductor 32 supporting the contact is folded to be parallel to the second branch $\mathbf{32}_b$ of the conductor 32 secured to connection strip 34. To in addition obtain two contact supports $\mathbf{36}_i$ located in the same plane parallel connection strip 34 in spite of the different point of departure resulting from superposition of connection parts $\mathbf{34}_i$, another fold 42 is made to offset the second branch $\mathbf{32}_b$ of each conductor 32 orthogonally to the plane of connection strip 34 by a half of its width, preferably at the level of connection part $\mathbf{34}_i$. The two offsets are opposed to one another for the two parts $\mathbf{30}_1$, $\mathbf{30}_2$ of the contact device.

According to the embodiment of FIG. 3, the contact device is thus achieved with a cutting tool and two folding tools. Other options (not shown) are possible, with for example a piece only comprising folding 40 into a U, and the other piece comprising folding 40 into a U associated with skewing 42 to take up the thickness difference. Two different cuts are in this case necessary for devices 30 of consequent size on account of the range of contactor 1.

Parts $\mathbf{30}_i$ of the contact device 30 are provided with suitable pads 44, in particular by brazing, and are then placed on one another in case 2 of contactor 1. It is advantageous to keep holes 38 of connection strips 34 free so as to be able to secure power supply bars 46 easily with the latter. To keep contact device 30 in position in contactor 1, any suitable means can be used; in particular the second branches $\mathbf{32}_b$ of the conductors can be drilled to couple pieces $\mathbf{30}_1$, $\mathbf{30}_2$ of the contact device 30 individually to case 2 by means of holes 48. The device 30 itself is only finalized once contactor 1 has been fitted. Securing between connection parts $\mathbf{34}_i$ will, in most cases, only be completed when contactor 1 is fitted in the electrical distribution system by connecting bars 46.

The sets of bars 46 are connected directly onto connection strips 34. In particular, in the case of a 2100 A contactor, the standard requires four 100×5 mm coppered bars. Each of bars 46 can be secured on one or more holes 38 of connection strip 34. Depending on the options, bars 46 can be placed at each surface of connection strip 34 (FIG. 3C), but also between its two sandwiched connection parts $\mathbf{34}_1$, $\mathbf{34}_2$. This non-illustrated alternative embodiment can improve the thermal and/or electrical conductibility and reduce heating at the connection strips 34 even more. The dimensions of the preferred embodiment of the invention are moreover such that the assembly formed by set of bars 46/contact device 30 rests on a surface, and therefore a mass, that are maximal, which improves the heat dissipation even further. In particular the copper surface of set of bars 46 is thus substantially equal to twice the surface of connection strip 34.

The design according to the invention thereby enables heating of connection strips 4, 34, of a stationary contact device 20, 30 to be reduced, in particular for a use as resistive load of a contactor 1. The dimensions of contactor 1 can then be reduced, which is all the more appreciable in the case where three devices 20, 30 are juxtaposed for a three-phase use. Despite the compactness, at least two contacts 10, 44 per phase are made, without any detriment either to the reliability of contactor 1 or to the thermal resistance at the level of contact pads 44. Furthermore, joining strips 4, 34 of the plurality of contacts 10, 44 of the same phase in parallel prevents wiring errors on the bars 6, 46 and makes fitting simpler. Eliminating the bolted connections moreover reduces heating internal to case 2. Finally, pieces $\mathbf{20}_i$, $\mathbf{30}_i$ are designed to limit the industrial investment and thereby reduce costs. Suitable cutting of pieces $\mathbf{30}_i$ of the device can also enable raw material losses to be minimized, thereby reducing the amount of copper used.

Although the invention has been described with reference to a three-phase contactor with double high-power contacts for a resistive load, it is not limited thereto and can be used on switchgear intended for AC3 or other uses. Likewise, although the design of the stationary contact devices according to the invention finds its major advantages for contactors of more than 1000 or 1300 A, in particular 1700, 2100 or 2500

A, in particular load-side from wind power generators, the solution according to the invention can be adopted for lower powers. Finally, the features of the different embodiments described can be combined with one another in a different manner.

The invention claimed is:

1. A contact device for an electrical contactor comprising:

a substantially flat connection strip having a strip thickness and for connection of power supply bars to the contactor;

at least two conductors each extending longitudinally from one of its ends which is secured to the connection strip and to a stationary contact support for operating in conjunction with a movable contact of the contactor;

wherein the contact device comprises at least two pieces, each piece being unitary, folded conducting metal; each piece comprises one of the conductors and a connection part; and the connection parts are of identical shape and of smaller thickness than the connection strip thickness so that superposition of said connection parts forms the connection strip of said strip thickness.

2. The device according to claim 1 wherein the thickness of the connection strip is greater than 8 mm.

3. The device according to claim 1 wherein the contact supports of each of the conductors are located in the same plane parallel to and offset with respect to the connection strip.

4. The device according to claim 1 comprising two pieces and wherein the connection strip is rectangular, one of its sides being extended on both of its edges by the two conductors.

5. The device according to claim 4 wherein the two pieces are from the same piece of metal folded to form each of said parts.

6. The device according to claim 4 wherein each of the conductors is U-shaped with two parallel branches, the first branch comprising the contact support in the same plane parallel to the connection strip, and the second branch is parallel to the first branch and offset with respect to its respective connection part.

7. The device according to claim 6 wherein the folds of the two pieces are identical.

8. The device according to claim 1 wherein the connection strip includes four holes for securing the connection parts to one another.

9. The device according to claim 1 further comprising a contact pad of silver alloy brazed onto the contact support of each conductor.

10. An electrical contactor comprising a case wherein at least one pair of contact devices according to claim 1 is partially positioned, and a contact bridge is moveable to establish connection between the stationary contacts of each pair of contact devices.

11. The contactor according to claim 10 comprising three pairs of contact devices similar to one another, the contact devices being juxtaposed in the plane of their connection strips.

12. A contact device for an electrical contactor comprising:

a substantially flat connection strip having a strip thickness greater than 8 mm and for connection of power supply bars to the contactor; two conductors each extending longitudinally from one of its ends which is secured to the connection strip and to a stationary contact support for operating in conjunction with a movable contact of the contactor; wherein the contact device comprises two pieces, each being unitary folded conducting metal, each piece comprising one of the conductors and a connection part which is of identical in shape to, and of smaller thickness than the connection strip of the device so that superposition of said parts forms the connection strip.

13. The device according to claim 12 further comprising a contact pad of silver alloy brazed onto the contact support of each conductor, and wherein the contact supports of each of the conductors are located in the same plane parallel to, and offset from, the connection strip.

14. The device according to claim 12 wherein each of the conductors is U-shaped with two parallel branches, the first branches comprising the contact supports located in the same plane parallel to the connection strip, and the second branches being parallel to the first branches and offset with respect to their respective connection parts.

15. The device according to claim 14 wherein the folds of the two conductors are identical, and the two pieces are from the same piece of metal folded to form each of said parts.

16. The device according to claim 12 wherein the connection strip has four holes therein for securing the connection parts to one another.

17. An electrical contactor comprising a case wherein at least one pair of contact devices according to claim 12 is partially positioned, and wherein is housed a movable contact bridge for establishing connection between the stationary contacts of each pair of contact devices.

18. A three phase electrical contactor comprising:

a case, three pairs of stationary contact devices partially positioned in the case, and at least one movable contact bridge in the case, said at least one bridge for establishing connection between the stationary contacts of each pair of contact devices;

wherein each contact device comprises a substantially flat connection strip for connection of power supply bars of the contactor and at least two conductors extending longitudinally from one of its ends which is secured to the connection strip and to a stationary contact support, the contact devices being juxtaposed in the plane of their respective connection strips;

and each contact device comprises at least two pieces, each being unitary folded conducting metal, each piece comprising one of the conductors and a connection part which is identical in shape to and of smaller thickness than the connection strip of the device so that superposition of said parts forms the connection strip.

19. The electrical contactor according to claim 18 wherein the contact supports of each of the conductors are located in the same plane parallel to and offset with respect to the connection strip, and the connection strip includes four holes for securing the connection parts to one another.

20. The electrical contactor according to claim 18 wherein each contact device comprises two pieces, each piece having a rectangular connection part, one side of which is extended by the conductor which is U-shaped with two parallel branches, the first branch comprising the contact supports in the same plane parallel to the connection strip, and the second branch is parallel to the first branch and offset with respect to its respective connection part.

* * * * *